US010585447B1

(12) United States Patent
Tanimoto

(10) Patent No.: US 10,585,447 B1
(45) Date of Patent: Mar. 10, 2020

(54) VOLTAGE GENERATOR

(71) Applicant: Dialog Semiconductor (UK) Limited, London (GB)

(72) Inventor: Susumu Tanimoto, Tokyo (JP)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/185,335

(22) Filed: Nov. 9, 2018

(51) Int. Cl.
*G05F 3/26* (2006.01)

(52) U.S. Cl.
CPC ..... *G05F 3/262* (2013.01)

(58) Field of Classification Search
CPC . G05F 3/262; G05F 3/26; G05F 3/265; G05F 3/30
See application file for complete search history.

(56) References Cited

U.S. PATENT DOCUMENTS 5,376,839 A * 12/1994 Horiguchi ..... G05F 1/465 323/313
6,529,066 B1 * 3/2003 Guenot ..... G05F 3/30 323/313
7,002,401 B2 * 2/2006 Khalid ..... G11C 27/005 323/316
7,142,044 B2 * 11/2006 Sano ..... G05F 1/575 327/540
9,383,764 B1 7/2016 Tanimoto
9,590,504 B2 3/2017 Al-Shyoukh et al.
10,007,289 B2 * 6/2018 Tanimoto ..... G05F 3/262
2008/0297234 A1 * 12/2008 Moholt ..... G05F 3/262 327/541
2009/0051416 A1 * 2/2009 Ibuka ..... G05F 3/08 327/538
2015/0137780 A1 * 5/2015 Lerner ..... G05F 1/56 323/280
2015/0234412 A1 8/2015 Al-Shyoukh et al.
2015/0234413 A1 8/2015 Al-Shyoukh et al.
2016/0349786 A1 * 12/2016 Fronczak ..... G05F 3/267
2018/0210480 A1 * 7/2018 Sone ..... G05F 3/267
(Continued)

OTHER PUBLICATIONS

"MOS Voltage Reference Based on Polysilicon Gate Work Function Difference," by Henri J. Oguey et al., IEEE Journal of Solid-State Circuits, vol. SC-15, No. 3, Jun. 1980, pp. 264-269.
(Continued)

*Primary Examiner* — Fred E Finch, III
*Assistant Examiner* — Sisay G Tiku
(74) *Attorney, Agent, or Firm* — Saile Ackerman LLC; Stephen B. Ackerman

(57) ABSTRACT

A voltage generator and a method for generating an output voltage is presented. The generator has a current mirror circuit with a first transistor having a gate and a first terminal, and a second transistor having a gate coupled to the gate of the first transistor, and with a first terminal coupled to a feedback node. A third transistor has a gate, a first terminal and a second terminal. The first terminal is coupled to the feedback node and the second terminal is coupled to an output node. A fourth transistor has a gate coupled to the third transistor. There is a current source coupled to the output node, and a feedback circuit to detect a terminal voltage at the feedback node and to control the terminal voltage by adjusting a gate voltage at the gate of the second transistor.

20 Claims, 5 Drawing Sheets

(56) References Cited

U.S. PATENT DOCUMENTS

| | | | | |
|---|---|---|---|---|
| 2019/0064867 | A1* | 2/2019 | Al-Shyoukh | G05F 3/20 |
| 2019/0129461 | A1* | 5/2019 | Sone | G05F 3/267 |

OTHER PUBLICATIONS

"CMOS Voltage Reference Based on Gate Work Function Differences in Poly-Si Controlled by Conductivity Type and Impurity Concentration," by Hirobumi Watanabe et al., IEEE Journal of Solid-State Circuits, vol. 38, No. 6, Jun. 2003, pp. 987-994.

* cited by examiner

VOLTAGE GENERATOR

TECHNICAL FIELD

The present disclosure relates a voltage generator for providing an output voltage. In particular, the present disclosure relates to a voltage generator that can operate with a low supply voltage, has low current consumption and can provide an accurate reference voltage as the output voltage.

BACKGROUND

FIG. 1 is a schematic of a voltage generator 100 in accordance with the prior art (U.S. Pat. No. 10,007,289 B2). The voltage generator 100 comprises a current mirror 102, two n-type transistors 104, 106, and a resistor 108. The current mirror 102 comprises two p-type transistors 110, 112.

The p-type transistor 110 has a source coupled to a supply voltage VDD, a drain coupled to a drain of the n-type transistor 106, and a gate coupled to a gate and a drain of the p-type transistor 112. The p-type transistor 112 has a source coupled to the supply voltage VDD.

The n-type transistor 106 has a source coupled to ground and has a gate coupled to its drain and a gate of the n-type transistor 104. The n-type transistor 104 has a drain coupled to the drain of the p-type transistor 112 and a source coupled to a first terminal of the resistor 108 at an output node NA. A second terminal of the resistor 108 is coupled to ground. An output voltage Vo is provided at the output node NA.

The transistors 104, 106, 108, 110 are metal oxide semiconductor field effect transistors (MOSFET), and as such p-type transistors may be referred to as PMOS, and n-type transistors may be referred to as NMOS.

The n-type transistors 104, 106 have different threshold voltages, and specifically, the threshold voltage of the n-type transistor 106 is greater than the threshold voltage of n-type transistor 104. The output voltage Vo is equal to the difference between the threshold voltages of the n-type transistors 104, 106. The difference between the threshold voltages may be equal to the bandgap voltage of silicon.

The output voltage Vo may be used as a reference voltage for use in a different part of a circuit implementing the voltage generator 100 or may be provided to another circuit for use as a reference voltage.

Operation of the voltage generator 100 requires that a minimum operation voltage is provided. The operation voltage is the voltage difference between the supply voltage VDD and ground, and as such, in the voltage generator 100, the minimum operation voltage necessary to operate the voltage generator 100 corresponds to a minimum supply voltage VDD.

The minimum operation voltage is dependent on the threshold voltages of the n-type transistors 104, 106 and the minimum operation voltage may be lowered by reducing the threshold voltages of the n-type transistors 104, 106.

Additionally, the minimum operation voltage is dependent on the series coupling of the p-type transistor 112, the n-type transistor 104 and the resistor 108 from the supply voltage VDD to ground. The voltage from the source of the p-type transistor 112 to ground is equal to the sum of the voltage across the source and drain (the source-to-drain voltage) of the p-type transistor 112, the voltage across the drain and source (the drain-to-source voltage) of the n-type transistor 104 and the output voltage Vo. The supply voltage VDD must be sufficiently large such that the portion of the supply voltage VDD provided across the drain and source of the n-type transistor 104 is sufficiently large to operate the n-type transistor 104 in its saturation mode.

In the case that the output voltage Vo is approximately equal to the bandgap voltage of silicon, as in the voltage generator 100, the output voltage Vo is approximately equal to 1.2V and the minimum operation voltage may be greater than or equal to 2V in common technology. As the output voltage Vo is dependent on the bandgap voltage of silicon, the minimum operation voltage cannot be decreased below approximately 2V by reducing the threshold voltage of the n-type transistors 104, 106.

The threshold voltage is the minimum voltage across the gate and source (the gate-to-source voltage) of a transistor that permits a current to flow between the source and drain terminals of the transistor. As the drain of the p-type transistor 112 is coupled to its gate, the source-to-drain voltage of the p-type transistor 112 is limited by the threshold voltage of the p-type transistor.

The threshold voltage of the p-type transistor 112 is greater than or equal to 0.6V in the voltage generator 100 for low current operation and to avoid the influence of leakage current. The source-to-drain voltage of the p-type transistor 112 must be equal to threshold voltage to permit current flow. Therefore the source-to-drain voltage may be approximately equal to or greater than 0.6V. Therefore, the requirements for the source-to-drain voltage of the p-type transistor 112 impacts the minimum operation voltage of the voltage generator 100.

SUMMARY

It is desirable to provide a voltage generator with a reduced minimum operation voltage when compared to the prior art.

According to a first aspect of the disclosure there is provided a voltage generator for generating an output voltage, comprising a current mirror circuit comprising a first transistor comprising a gate and a first terminal, and a second transistor comprising a gate coupled to the gate of the first transistor, and comprising a first terminal coupled to a feedback node, a third transistor comprising a gate, a first terminal and a second terminal, wherein the first terminal is coupled to the feedback node and the second terminal is coupled to an output node, a fourth transistor comprising a gate coupled to the gate of the third transistor, and comprising a first terminal coupled to the first terminal of the first transistor and the gate of the fourth transistor, and a current source coupled to the output node, and a feedback circuit configured to detect a terminal voltage at the feedback node and to control the terminal voltage by adjusting a gate voltage at the gate of the second transistor, wherein: the current mirror circuit is configured to provide a first current to the third transistor and a second current to the fourth transistor, the first and second transistors are one of p-type and n-type transistors and the third and fourth transistors are the other of p-type and n-type transistors, and the output voltage is provided at the output node.

Optionally, the current source comprises a resistor.

Optionally, the fourth transistor has a greater threshold voltage than that of the third transistor.

Optionally, the fourth transistor is an anti-doped-gate transistor.

Optionally, the first and second transistors are p-type transistors and the third and fourth transistors are n-type transistors.

Optionally, the first and second transistors are n-type transistors and the third and fourth transistors are p-type transistors.

Optionally, the feedback circuit comprises an op amp comprising a first input coupled to a reference voltage, a second input coupled to the feedback node and an output coupled to the gates of the first and second transistors.

Optionally, the voltage generator comprises reference voltage circuitry configured to provide the reference voltage, the reference voltage circuitry comprising a fifth transistor comprising a gate coupled to the gates of the third and fourth transistors, and a resistive element coupled to a first terminal of the fifth transistor at a reference voltage output node, wherein the reference voltage is provided at the reference voltage output node and the reference voltage output node is coupled to the first input of the op amp.

Optionally, the fourth and fifth transistors are anti-doped-gate transistors.

Optionally, the fifth transistor is the same transistor type as that of the third and fourth transistors.

Optionally, the first and second transistors are p-type transistors and the third, fourth and fifth transistors are n-type transistors.

Optionally, the first and second transistors are n-type transistors and the third, fourth and fifth transistors are p-type transistors.

Optionally, the voltage generator comprises one or more cascode transistors, wherein the or each cascode transistor is coupled to one of the first, second and third transistors.

According a second aspect of the disclosure there is provided a method of generating an output voltage using a voltage generator of the type comprising a current mirror circuit comprising a first transistor comprising a gate and a first terminal, and a second transistor comprising a gate coupled to the gate of the first transistor, and comprising a first terminal coupled to a feedback node, a third transistor comprising a gate, a first terminal and a second terminal, wherein the first terminal is coupled to the feedback node and the second terminal is coupled to an output node, a fourth transistor comprising a gate coupled to the gate of the third transistor, and comprising a first terminal coupled to the first terminal of the first transistor and the gate of the fourth transistor, a current source coupled to the output node, and a feedback circuit, wherein the first and second transistors are one of p-type and n-type transistors and the third and fourth transistors are the other of p-type and n-type transistors, the method comprising detecting a terminal voltage at the feedback node using the feedback circuit, controlling the terminal voltage by adjusting a gate voltage at the gate of the second transistor using the feedback circuit, providing a first current to the third transistor and a second current to the fourth transistor using the current mirror circuit, and providing the output voltage at the output node.

Optionally, the current source comprises a resistor.

Optionally, the fourth transistor has a greater threshold voltage than that of the third transistor.

Optionally, the fourth transistor is an anti-doped-gate transistor.

Optionally, the first and second transistors are p-type transistors and the third and fourth transistors are n-type transistors.

Optionally, the first and second transistors are n-type transistors and the third and fourth transistors are p-type transistors.

Optionally, the feedback circuit comprises an op amp comprising a first input coupled to a reference voltage, a second input coupled to the feedback node and an output coupled to the gates of the first and second transistors.

Optionally, the voltage generator comprises reference voltage circuitry comprising a fifth transistor comprising a gate coupled to the gates of the third and fourth transistors, and a resistive element coupled to a first terminal of the fifth transistor at a reference voltage output node, the method comprising providing the reference voltage from the reference voltage output node, and receiving the reference voltage at the first input of the op amp.

Optionally, the fourth and fifth transistors are anti-doped-gate transistors.

Optionally, the fifth transistor is the same transistor type as that of the third and fourth transistors.

Optionally, the first and second transistors are p-type transistors and the third, fourth and fifth transistors are n-type transistors.

Optionally, the first and second transistors are n-type transistors and the third, fourth and fifth transistors are p-type transistors.

Optionally, the voltage generator comprises one or more cascode transistors, wherein the or each cascode transistor is coupled to one of the first, second and third transistors.

BRIEF DESCRIPTION OF THE DRAWINGS

This disclosure is described in further detail below by way of example and with reference to the accompanying drawings, in which.

DESCRIPTION

Figure 1:
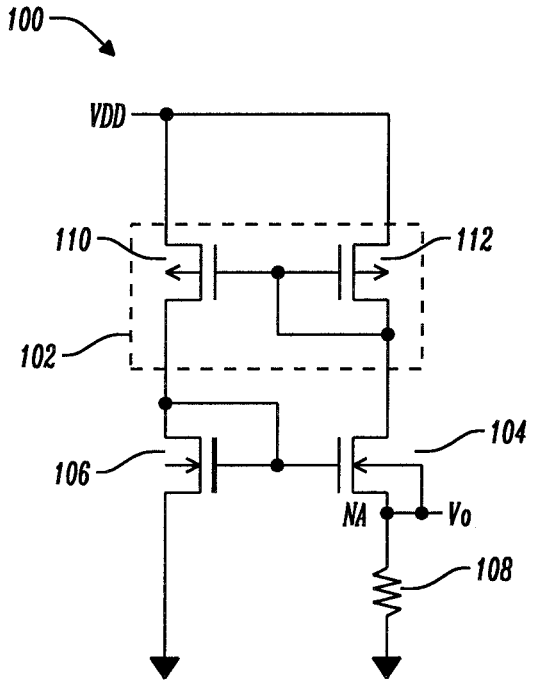
FIG. 1 Prior Art
FIG. 1 is a schematic of a voltage generator in accordance with the prior art.
Figure 2A:
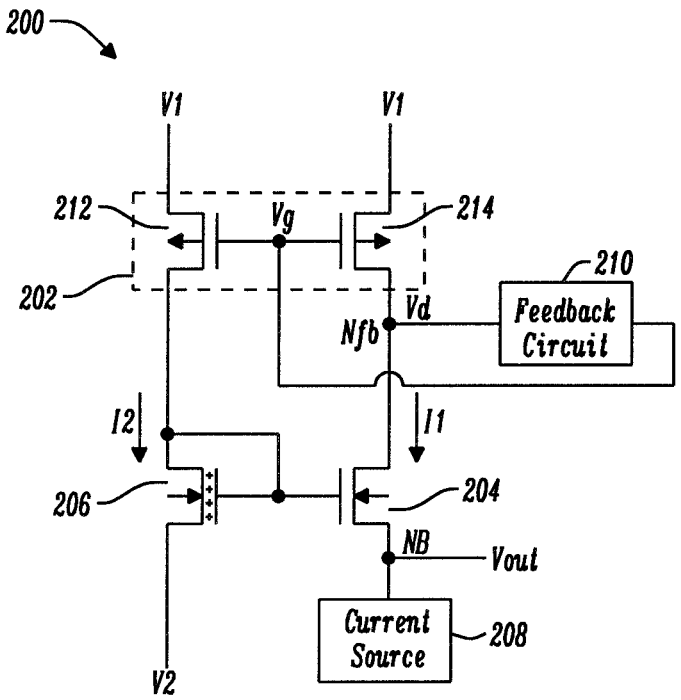
FIG. 2A is a schematic of a voltage generator in accordance with a first embodiment of the present disclosure.

FIG. 2A is a schematic of a voltage generator 200 for generating an output voltage Vout in accordance with a first embodiment of this disclosure. The voltage generator 200 comprises a current mirror circuit 202, transistors 204, 206, a current source 208 and a feedback circuit 210.

The current mirror circuit 202 comprises two transistors 212, 214 with their gates coupled. Each of the transistors 212, 214 comprise a first terminal and the first terminal of the transistor 214 is coupled to a feedback node Nfb. Each of the transistors 212, 214 comprise a second terminal coupled to a voltage V1.

The transistor 204 comprises a gate, a first terminal and a second terminal. The first terminal of the transistor 204 is coupled to the feedback node Nfb and the second terminal is coupled to an output node NB. The current source 208 is coupled to the output node NB. The output voltage Vout is provided at the output node NB.

The transistor 206 comprises a gate, a first terminal and a second terminal. The gate of the transistor 206 is coupled to the gate of the transistor 204, the first terminal is coupled to the first terminal of the transistor 212 and the gate of the transistor 206.

The feedback circuit 210 has an input coupled to the feedback node Nfb and has an output coupled to the gates of the transistors 212, 214. The feedback circuit 210 is configured to detect a terminal voltage Vd at the feedback node Nfb and to control the terminal voltage Vd by adjusting a gate voltage Vg at the gate of the transistor 214.

The current mirror circuit 202 is configured to provide a current I1 to the transistor 204 and a current I2 to the transistor 206. The transistors 212, 214 are one of p-type and n-type transistors and the transistors 204, 206 are the other of p-type and n-type transistors. In this specific embodiment, transistor 212, 214 are p-type transistors and transistors 204, 206 are n-type transistors.

Therefore, it will be appreciated that a first terminal of a transistor, as described herein, may be one of a source or a drain of the transistor and a second terminal of the transistor may be the other of the source or the drain of the transistor, depending on the transistor type. For example, in the present embodiment, the first terminal of the transistor 214 is its drain.

Further embodiments may comprise different transistor arrangements. For example, transistors 212, 214 may be n-type transistors and transistors 204, 206 may be p-type transistors, with appropriate commonplace modifications being made to the circuit to accommodate the different transistor types in accordance with the understanding of the skilled person.

The transistors 204, 206 have different threshold voltages, and specifically, the threshold voltage of the transistor 206 is greater than the threshold voltage of the transistor 204. The output voltage Vout is equal to the difference between the threshold voltages of the transistors 204, 206. The difference between the threshold voltages may be equal to the bandgap voltage of silicon.

A temperature coefficient of the output voltage Vout is dependent on the ratio of the currents I1, I2.

The current I1 is dependent on the current source 208 and the threshold voltage difference between the transistors 204, 206, which as discussed previously, is equal to the output voltage Vout.

To provide a threshold voltage of the transistor 206 that is greater than the threshold voltage of the transistor 204, the transistor 206 may be an anti-doped-gate transistor.

An anti-doped-gate transistor may also be referred to as a flipped gate transistor. A transistor is an anti-doped-gate transistor when its gate is doped with a doping type opposite to that of the transistor type. For example, an n-type transistor will be an anti-doped-gate transistor if it has a p-doped gate. In the present embodiment, the transistor 206 is an anti-doped-gate n-type transistor, and as such it has a p-doped gate. Additionally, the transistor 204 is an n-type transistor with an n-doped gate. The different doping of their gates results in the anti-doped-gate transistor 206 having a greater threshold voltage than that of the transistor 204.

Generating the output voltage Vout using the anti-doped-gate transistor 206 paired with the transistor 204 can provide an accurate and stable output voltage Vout that is suitable for use as a reference voltage.

It can be observed that the voltage generator 200 corresponds to the voltage generator 100 but with the addition of the feedback circuit 210 between the drain of the transistor 214 and its gate, and the generalisation of the resistor 108 to the current source 208. It will be appreciated that in the voltage generator 100, the resistor 108 functions as a current source. The inclusion of the feedback circuit 210 provides a reduced minimum operation voltage for the voltage generator 200 by controlling the terminal voltage Vd such that the transistors 212, 214 operate in their saturation mode. Therefore, the voltage generator 200 may have a reduced minimum operation voltage when compared to the voltage generator 100 of the prior art.

Figure 2B:
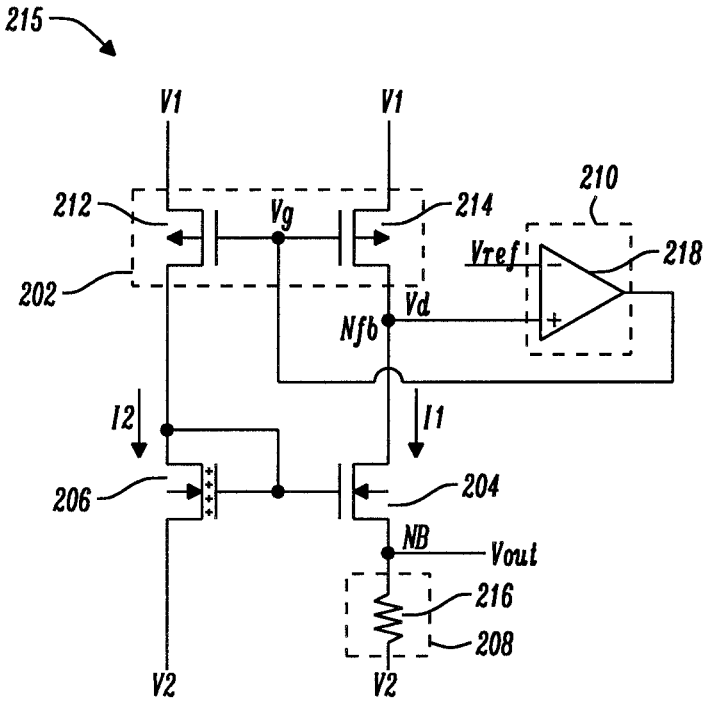
FIG. 2B is a schematic of a voltage generator in accordance with a second embodiment of the present disclosure.

FIG. 2B is a schematic of a voltage generator 215 in accordance with a second embodiment of this disclosure. The voltage generator 215 shares features with the voltage generator 200 and therefore common features between Figures are represented by common reference numerals and variables.

In the voltage generator 215, the current source 208 comprises a resistor 216. The resistor comprises a first terminal coupled to the output node NB and a second terminal coupled to the voltage V2.

The current I1 is dependent on the resistor 216 and the threshold voltage difference between the transistors 204, 206, which as discussed previously, is equal to the output voltage Vout.

In the voltage generator 215, the feedback circuit 210 comprises an op amp 218 comprising a first input coupled to a reference voltage Vref, a second input coupled to the feedback node Nfb and an output coupled to the gates of the transistors 212, 214.

Figure 3:
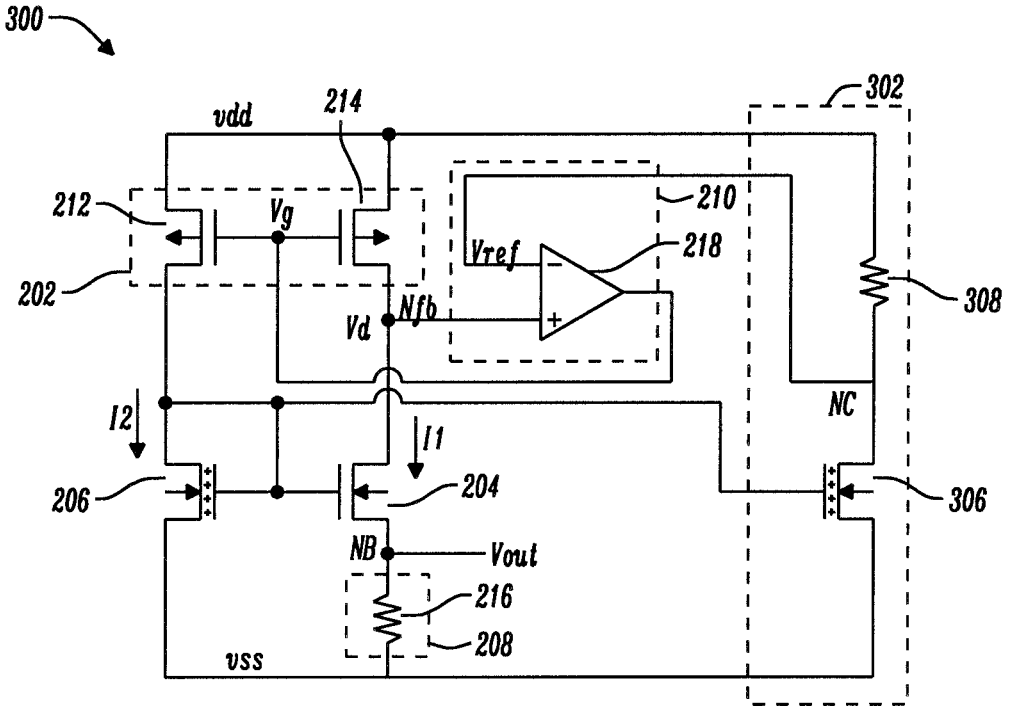
FIG. 3 is a schematic of a voltage generator in accordance with a third embodiment of the present disclosure.

FIG. 3 is a schematic of a voltage generator 300 in accordance with a third embodiment of this disclosure. The voltage generator 300 comprises the voltage generator 215, with reference voltage circuitry 302 for generating a reference voltage Vref for the op amp 218 of the feedback circuit 210, shown. Common features between the different Figures share common reference numerals and variables. In the present embodiment, the voltage V1 corresponds to a supply voltage vdd, provided at a positive supply terminal, and the voltage V2 corresponds to a supply voltage vss provided at a negative supply terminal. Therefore, the operation voltage is equal to the difference between the supply voltages vdd, vss. The supply voltage vss may correspond to ground, as in the voltage generator 100.

It will be appreciated that the reference voltage Vref that is generated and used within the voltage generator 300 is distinct from the output voltage Vout that may be used as an accurate and stable reference voltage for external circuitry.

The reference voltage circuitry 302 is configured to provide the reference voltage Vref to the first input of the op amp 218. The reference voltage circuitry 302 comprises a transistor 306 and a resistive element comprising a resistor 308. The transistor 306 comprises a gate coupled to the gates of the transistors 204, 206. The resistor 308 is coupled to a first terminal of the transistor 306 at a reference voltage output node NC. A second terminal of the transistor 306 is coupled to the voltage vss and the voltage vdd is coupled to the reference voltage output node NC via the resistor 308. The reference voltage Vref is provided at the reference voltage output node NC and the reference voltage output node NC is coupled to the first input of the op amp 218.

In operation, in the present embodiment, the reference voltage Vref at the reference voltage output node NC may be approximately equal to the supply voltage vdd minus 0.1V, such that the terminal voltage Vd at the feedback node Nfb is controlled to be approximately equal to the supply voltage vdd minus 0.1V.

The transistors 206, 306 may both be anti-doped-gate transistors. The transistors 212, 214 may be a different type to that of the transistors 204, 206, 306, and in this specific embodiment, the transistors 212, 214 are p-type transistors and the transistors 204, 206, 306 are n-type transistors. As discussed previously, further embodiments may comprise different transistor arrangements, in accordance with the understanding of the skilled person.

For a practical implementation of the voltage generator 300, the output voltage Vout may be approximately equal to 1.2V.

Preferably, the resistors 216, 308 are implemented using the same type of resistor structure and their layouts are unitized to achieve better matching of the resistors 216, 308. A current mirror (206+306) is formed by the transistors 206, 306 and, preferably, the transistors 206, 306 are matched. By "matched" it is meant that the components (such as the transistors 206, 306) have substantially similar electrical characteristics.

Compared with the voltage generator 100, the voltage generator 300 comprises the feedback circuit 210, coupled between the drain of the transistor 214 and its gate, and the reference voltage circuitry 302. The feedback circuit 210 comprises the op amp 218 that receives the reference voltage Vref, that is provided by the reference voltage circuitry 302. The terminal voltage Vd (corresponding to the drain voltage of the transistor 214 in the present embodiment) is controlled by the feedback circuit 210 and the reference voltage circuitry 302. Therefore, there is provided a feedback loop comprising the feedback circuit 210, the reference voltage circuitry 302 and the transistor 214.

The source-to-drain voltage of the transistor 214 is not limited by its threshold voltage because its gate is not coupled to its drain, as is the case for the p-type transistor 112 in the voltage generator 100.

The op amp 218 controls the terminal voltage Vd to be approximately equal to the reference voltage Vref by adjusting the gate voltage Vg. The reference voltage Vref provided at the reference voltage output node NC can be accurately controlled as it proportional to the output voltage Vout, which is typically controlled to a substantially high degree of accuracy.

Preferably, to minimise the minimum operation voltage, the transistors 204, 206, 212, 214 should be operated in their sub-threshold regions. A transistor operating in its sub-threshold region enables current flow between its drain and source terminals whilst it has a gate-source voltage below its threshold voltage. The sub-threshold region may be an efficient region of operation for a transistor. The current flow between a transistor's drain and source terminals may be referred to as its drain-source current.

If a transistor works in its sub-threshold region, a drain-to-source voltage of approximately 0.1V is typically sufficient for the transistor to be saturated and to provide a drain-source current that is approximately 98% of the drain-source current of the transistor when its gate-source voltage exceeds that of its threshold voltage.

Therefore, for the transistors 204, 214 operating in their subthreshold regions, the minimum operation voltage of the voltage generator 300 may be approximately equal to 1.4V. This results from a source-to-drain voltage of approximately 0.1V for the transistor 214, a drain-to-source voltage of approximately 0.1V for the transistor 204 and the output voltage Vout approximately equal to 1.2V.

Figure 4:
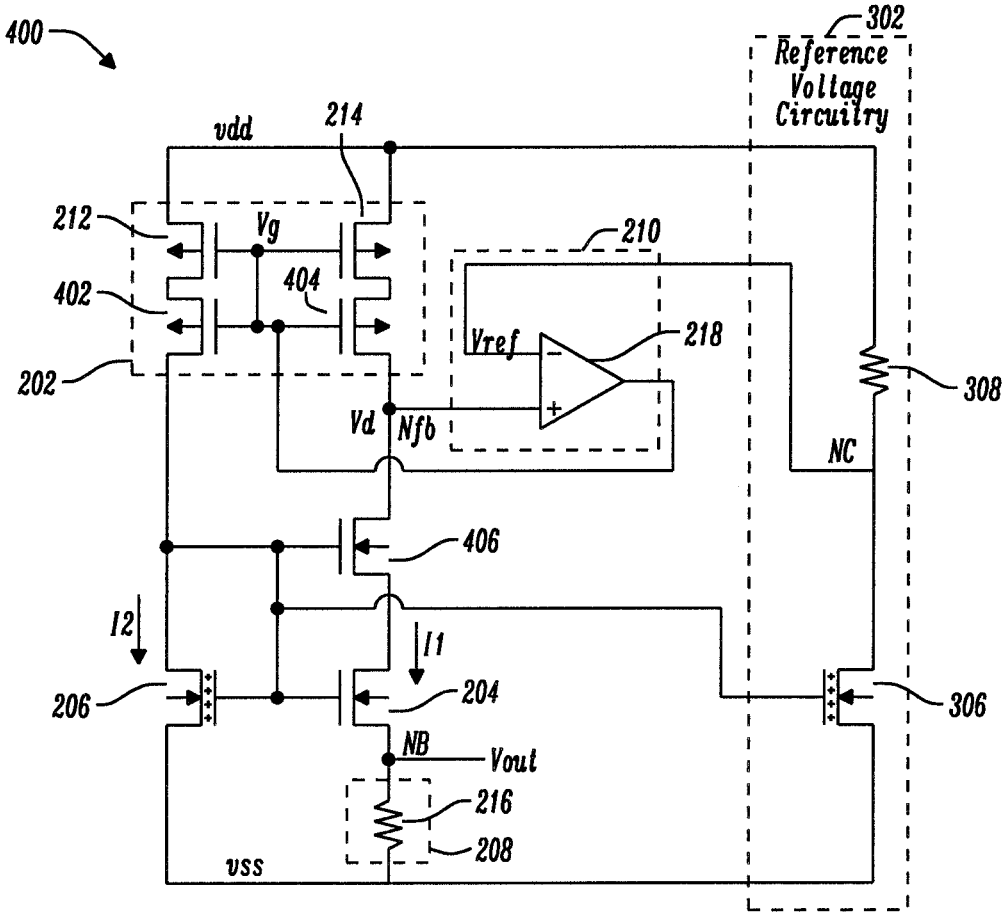
FIG. 4 is a schematic of a voltage generator in accordance with a fourth embodiment of the present disclosure.

FIG. 4 is a schematic of a voltage generator 400 in accordance with a fourth embodiment of this disclosure. The voltage generator 400 corresponds to the voltage generator 300 but further comprises one or more cascode transistors. Common features between the different Figures share common reference numerals and variables.

The voltage regulator 400 comprises one or more cascode transistors, with the or each cascode transistor being coupled to one of the transistors 204, 212, 214. In this specific embodiment, the voltage regulator 400 comprises three cascode transistors 402, 404, 406.

A drain of the transistor 212 is coupled to a source of the cascode transistor 402 and the gate of the transistor 212 is coupled to a gate of the cascode transistor 402. The cascode transistor 402 has a drain coupled to a drain of the transistor 206.

A drain of transistor 214 is coupled to a source of cascode transistor 404 and the gate of the transistor 214 is coupled to a gate of the cascode transistor 404. The cascode transistor 404 has a drain coupled to the feedback node Nth. Therefore, compared the voltage generator 300, in the voltage generator 400, the transistor 214 is coupled to the feedback node Nth via the cascode transistor 404.

A drain of the transistor 204 is coupled to a source of the cascode transistor 406 and the gate of the transistor 204 is coupled to a gate of the cascode transistor 406. The cascode transistor 406 has a drain coupled to the feedback node Nfb. Therefore, compared to the voltage generator 300, in the voltage generator 400 the transistor 204 is coupled to the feedback node Nth via the cascode transistor 406.

The cascode transistors 402, 404 are p-type transistors and the cascode transistor 406 is an n-type transistor in the present embodiment. It will be appreciated that in a further embodiment, the transistors and the cascode transistors may be of a different type, with the appropriate circuit modifications being made in accordance with the understanding of the skilled person.

The inclusion of the cascode transistors 400, 402, 404 provides better stability again variation in the supply voltages vdd, vss.

Preferably, the cascode transistors 402, 404 are saturated, and may required a source-to-drain voltage of approximately 0.1V to provide an improvement in stability of the supply voltages vdd, vss when compared with the voltage generator 300. Additionally, it is desirable that the cascode transistor 406 has a drain-to-source voltage of approximately 0.1V as required for the cascode transistor 406 to operate in saturation.

In operation, in the present embodiment, the reference voltage Vref at the reference voltage output node NC may be approximately equal to the supply voltage vdd minus 0.2V, such that the terminal voltage Vd at the feedback node Nfb is controlled to be approximately equal to the supply voltage vdd minus 0.2V.

The minimum operation voltage of the voltage generator 400 may be approximately equal to 1.6V. This results from a source-to-drain voltage of approximately 0.1V for each of the transistors 214, 404, a drain-to-source voltage of approximately 0.1V for each of the transistors 204, 406 and an output voltage Vout of approximately 1.6V.

Compared the voltage generator 300, there is an increase in the minimum operation voltage of approximately 0.2V for the voltage generator 400. However, the voltage generator 400 provides the added benefits of the cascode transistors that improves stability for variation in the supply voltage vdd, vss.

Figure 5A:
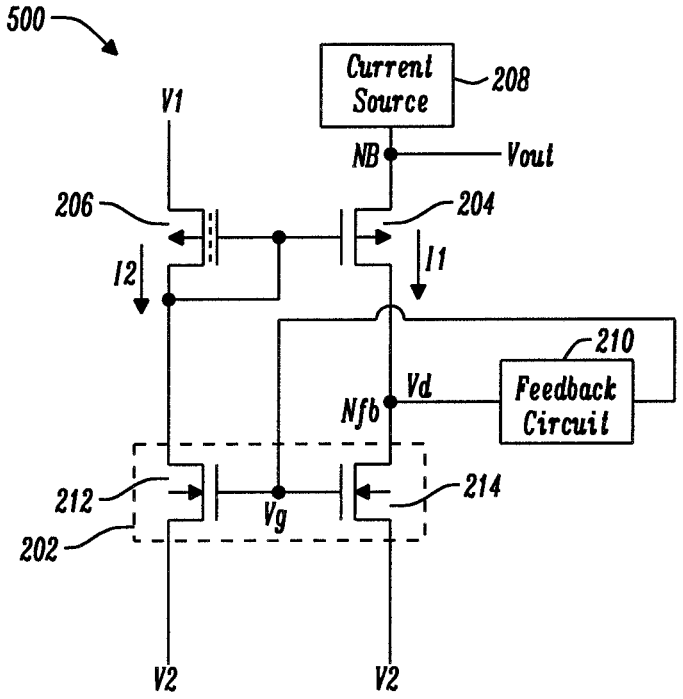
FIG. 5A is a schematic of a voltage generator in accordance with a fifth embodiment of the present disclosure.
Figure 5B:
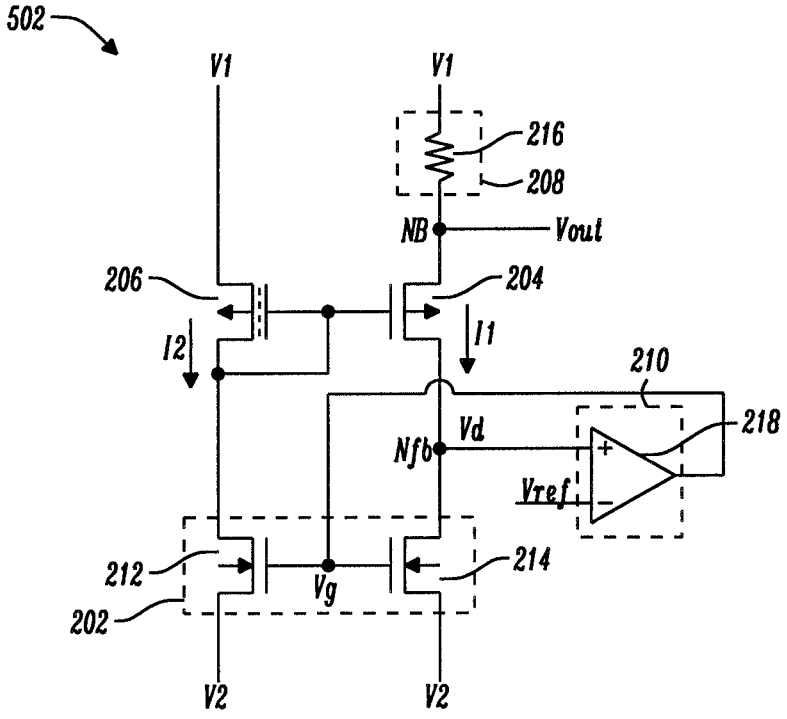
FIG. 5B is a schematic of a voltage generator in accordance with a sixth embodiment of the present disclosure.

As discussed previously, the types of transistors used in the voltage generators described herein, may be changed in accordance with the understanding of the skilled person. FIG. 5A is a schematic of a voltage generator 500 in accordance with a fifth embodiment of the present disclosure and FIG. 5B is a schematic of a voltage generator 502 in accordance with a sixth embodiment of the present disclosure. Common features between Figures are represented by common reference numerals and variables.

The voltage generator 500 corresponds to the voltage generator 200 and the voltage generator 502 corresponds to the voltage generator 215, but in the voltage generators 500, 502, the transistors 204, 206 are p-type transistors and the transistors 212, 214 are n-type transistors. Transistor 206 is an anti-doped-gate transistor, and in the present embodiments transistor 206 is an anti-doped-gate p-type transistor, and as such has an n-doped gate.

It will be clear to the skilled person how the embodiments presented in FIGS. 5A and 5B may incorporate the reference voltage circuitry 302 and/or the cascode transistors 402, 404, 406 as described previously.

The embodiments presented herein may provide an output voltage Vout having +/−0.3% variation over a temperature range typical of the normal operating conditions. Additionally, for a practical implementation of the embodiments presented, the embodiments can have currents I1, I2 less than 100 nA during operation and can provide a minimum operation voltage of less than 2V.

Various improvements and modifications may be made to the above without departing from the scope of the disclosure.

What is claimed is:

1. A voltage generator for generating an output voltage, comprising: a current mirror circuit comprising: a) a first transistor comprising a gate and a first terminal; and b) a second transistor comprising a gate coupled to the gate of the first transistor, and comprising a first terminal coupled to a feedback node; a third transistor comprising a gate, a first terminal and a second terminal, wherein the first terminal is coupled to the feedback node and the second terminal is coupled to an output node; a fourth transistor comprising a gate coupled to the gate of the third transistor, and comprising a first terminal coupled to the first terminal of the first transistor and the gate of the fourth transistor; and a current source coupled to the output node; and a feedback circuit configured to detect a terminal voltage at the feedback node and to control the terminal voltage according to a reference voltage by adjusting a gate voltage at the gate of the second transistor; wherein: the current mirror circuit is configured to provide a first current to the third transistor and a second current to the fourth transistor; the first and second transistors are one of p-type and n-type transistors and the third and fourth transistors are the other of p-type and n-type transistors; and the output voltage is provided at the output node.

2. The voltage generator of claim 1, wherein the current source comprises a resistor.

3. The voltage generator of claim 1, wherein the fourth transistor has a greater threshold voltage than that of the third transistor.

4. The voltage generator of claim 3, wherein the fourth transistor is an anti-doped-gate transistor.

5. The voltage generator of claim 1, wherein the first and second transistors are p-type transistors and the third and fourth transistors are n-type transistors.

6. The voltage generator of claim 1, wherein the first and second transistors are n-type transistors and the third and fourth transistors are p-type transistors.

7. The voltage generator of claim 1, wherein the feedback circuit comprises an op amp comprising a first input coupled to the reference voltage, a second input coupled to the feedback node and an output coupled to the gates of the first and second transistors.

8. The voltage generator of claim 7, comprising reference voltage circuitry configured to provide the reference voltage, the reference voltage circuitry comprising:

a fifth transistor comprising a gate coupled to the gates of the third and fourth transistors; and a resistive element coupled to a first terminal of the fifth transistor at a reference voltage output node; wherein:

the reference voltage is provided at the reference voltage output node and the reference voltage output node is coupled to the first input of the op amp.

9. The voltage generator of claim 8, wherein the fourth and fifth transistors are anti-doped-gate transistors.

10. The voltage generator of claim 8, wherein the fifth transistor is the same transistor type as that of the third and fourth transistors.

11. The voltage generator of claim 10, wherein the first and second transistors are p-type transistors and the third, fourth and fifth transistors are n-type transistors.

12. The voltage generator of claim 10, wherein the first and second transistors are n-type transistors and the third, fourth and fifth transistors are p-type transistors.

13. The voltage generator of claim 1, comprising one or more cascode transistors, wherein the, or each, cascode transistor is coupled to one of the first, second and third transistors.

14. A method of generating an output voltage using a voltage generator comprising the steps of: a current mirror circuit comprising: a) a first transistor comprising a gate and a first terminal; and b) a second transistor comprising a gate coupled to the gate of the first transistor, and comprising a first terminal coupled to a feedback node; a third transistor comprising a gate, a first terminal and a second terminal, wherein the first terminal is coupled to the feedback node and the second terminal is coupled to an output node; a fourth transistor comprising a gate coupled to the gate of the third transistor, and comprising a first terminal coupled to the first terminal of the first transistor and the gate of the fourth transistor; a current source coupled to the output node; and a feedback circuit; wherein: the first and second transistors are one of p-type and n-type transistors and the third and fourth transistors are the other of p-type and n-type transistors; the method comprising: detecting a terminal voltage at the feedback node using the feedback circuit; controlling the terminal voltage according to a reference voltage by adjusting a gate voltage at the gate of the second transistor using the feedback circuit; providing a first current to the third transistor and a second current to the fourth transistor using the current mirror circuit; and providing the output voltage at the output node.

15. The method of claim 14, wherein the current source comprises a resistor.

16. The method of claim 14, wherein the fourth transistor has a greater threshold voltage than that of the third transistor.

17. The method of claim 16, wherein the fourth transistor is an anti-doped-gate transistor.

18. The method of claim 14, wherein the first and second transistors are p-type transistors and the third and fourth transistors are n-type transistors.

19. The method of claim 14, wherein the first and second transistors are n-type transistors and the third and fourth transistors are p-type transistors.

20. The method of claim 14, wherein the feedback circuit comprises an op amp comprising a first input coupled to the reference voltage, a second input coupled to the feedback node and an output coupled to the gates of the first and second transistors.

* * * * *